US006555278B1

(12) United States Patent
Loveridge et al.

(10) Patent No.: US 6,555,278 B1
(45) Date of Patent: Apr. 29, 2003

(54) COLOR FILTER ARRAY FILM

(75) Inventors: Jennifer C. Loveridge, North Harrow (GB); Richard Sharman, Dunstable (GB); Michael J. Simons, Ruislip (GB); John A. Weldy, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 193 days.

(21) Appl. No.: 09/715,494

(22) Filed: Nov. 17, 2000

(30) Foreign Application Priority Data

Dec. 1, 1999 (GB) ..... 9928270

(51) Int. Cl.[7] ..... G03C 1/825
(52) U.S. Cl. ..... 430/7; 430/511
(58) Field of Search ..... 430/7, 511

(56) References Cited

U.S. PATENT DOCUMENTS

| | | | |
|---|---|---|---|
| 1,709,563 | A | 4/1929 | Christensen |
| 2,339,951 | A | 1/1944 | Schettler et al. |
| 4,458,175 | A | 7/1984 | Weekley |
| 5,418,119 | A | 5/1995 | Simons |
| 5,420,003 | A | 5/1995 | Gasper et al. |
| 5,804,359 | A | 9/1998 | Simons |
| 5,978,105 | A | 11/1999 | Sharman et al. |

FOREIGN PATENT DOCUMENTS

| | | |
|---|---|---|
| DE | 490388 | 1/1930 |
| DE | 962403 | 4/1957 |
| GB | 504283 | 4/1939 |

OTHER PUBLICATIONS

Research Disclosure, vol. 111, Jul. 1973; Item 11128.

*Primary Examiner*—John A. McPherson
(74) *Attorney, Agent, or Firm*—Frank Pincelli

(57) ABSTRACT

A color film comprises a support layer, a layer formed of a color filter array having at least three spectrally distinguishable types of color element and an emulsion layer unit. The film further includes means for emitting or reflecting light which has been modulated by the filter array but not by the image pattern formed in the emulsion layer.

15 Claims, 2 Drawing Sheets

COLOR FILTER ARRAY FILM

FIELD OF THE INVENTION

The invention relates to color film and to a method of forming an image by scanning the film.

BACKGROUND OF THE INVENTION

The great majority of color photographs today are taken using chromogenic color film, in which color-forming couplers, which may be incorporated in the film or present in the processing solution, form cyan, magenta and yellow dyes by reaction with oxidized developing agent which is formed where silver halide is developed in an imagewise pattern. Such films require a development process which is carefully controlled in respect of time and temperature, which is usually followed by a silver bleaching and a fixing step, and the whole process typically takes several minutes and needs complex equipment.

Gasper et al, in U.S. Pat. No. 5,420,003, disclose a photographic color film which employs black-and-white developed color records separated by fluorescent or emissive interlayers. The film offers rapid and simple processing, although its structure of superimposed color records means that processing chemicals have to diffuse a considerable distance down through the various coated layers before they can reach the emulsion layer nearest the base, which increases the time required to process the film. Care must also be taken when altering any of the processing conditions to ensure that all three color records are affected in a similar way, otherwise the color balance of the film may be adversely affected. After opto-electronic scanning, the optical densities in the separate color records are calculated by taking differences and performing other appropriate mathematical operations, after which an image of the original scene is reconstructed.

Simons in U.S. Pat. No. 5,418,119 discloses a photographic color film which employs black-and-white developed color records separated by interlayer units which are capable of passing light through to an underlying emulsion layer unit and are capable, after photographic processing, of reflecting light in at least one wavelength region. The imagewise exposed photographic element can be photographically processed to produce a silver image in each of the emulsion layer units, and can be reflection scanned utilizing reflection from the interlayer unit to provide a first record of the image information in one of the two emulsion layer units and can be reflection or transmission scanned to provide second and third records of the image information in the other two emulsion layer units. The first, second and third records can be compared to obtain separate blue, green and red exposure records. This film suffers from difficulties similar to those of the film disclosed by Gasper et al, in that processing chemicals have to diffuse a considerable distance down through the various coated layers before they can reach the emulsion layer nearest the base, which increases the time required to process the film, and also means that care must be taken when altering any of the processing conditions to ensure that all three color records are affected in a similar way, otherwise the color balance of the film may be adversely affected.

The invention aims to provide a film and a method for taking color photographs which use digital image processing to display or print the image and require only a very simple, rapid and reliable chemical processing step.

The object of the digital image processing is to provide a color image of higher quality than would otherwise be achievable by, for example, an optical print of the color filter array (CFA) film. The primary aim of the image processing is to remove those artifacts in the scanned image data that result from the inclusion of a color filter array in the film, in particular colored noise in the case of a film with a random or irregular CFA, or colored structure in the case of a film with a regular CFA. Loss of color saturation may also be corrected.

SUMMARY OF THE INVENTION

According to the present invention there is provided a color film for recording an image comprising a support layer, a layer formed of a color filter array having at least three spectrally distinguishable types of color element, and at least one emulsion layer, the film further including means for emitting or reflecting light which has been modulated by the color filter array but has not been substantially modulated by the image pattern formed in the at least one emulsion layer.

The means may be a reflective, scattering or fluorescent layer interposed between the color filter array and the emulsion layer. Alternatively, the means may be reflective, scattering or fluorescent material within the color filter array layer, in the space between the color elements of the array and/or within the color elements themselves.

The color filter array itself may be either regular or random.

The present invention further provides a method of forming a color image of a scene from an imagewise exposed photographic film, the film comprising a support layer, a layer formed of a color filter array having at least three spectrally distinguishable types of color element and at least one emulsion layer, the film further including means for emitting or reflecting light which has been modulated by the color filter array but has not substantially been modulated by the image pattern formed in the at least one emulsion layer, the method comprising developing the image of the scene formed in the emulsion layer, electro-optically scanning the resultant image through the color filter array, electro-optically scanning the color filter array by light which has not been substantially modulated by the image formed in the emulsion layer, and digitally image processing the two sets of scanned image information to give an electronically coded representation of the scene.

The color filter array may be scanned by light which has been reflected or emitted from the color filter array or from a layer between the color filter array and the emulsion layer.

The film and method of the present invention provides a light sensitive emulsion layer unit, which may comprise one or more layers, which is sensitive to light which has passed through each or all of the different color elements of the color filter array, so that the image information for each color record is recorded in the emulsion layer unit. This unit can be thinner than the three separate color-sensitive emulsion layer units disclosed in the prior art and so provides more rapid photographic processing. Also, variations to the photographic process, whether inadvertent or intentional, will affect all color records equally, since the color information is contained in the one emulsion layer unit, and so the color balance will be retained. A further distinction between the film and method of the invention and the prior art is that the light from the reflection mode scan does not pass through the image records, but passes through the color filter array then is reflected back through the array to the scanner. This is advantageous because the optical density range to be scanned is limited to that of the color filter array, typically a density of 1.5 in any one color, and so it is not necessary to use an excessively bright lamp.

DETAILED DESCRIPTION OF THE INVENTION

Figure 1:
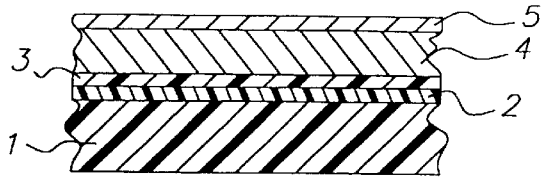
FIG. 1 is a diagram of a film according to the invention.

FIG. 1 shows a film according to a first embodiment of the invention. In this embodiment the film is coated with a color filter array 2 nearest to the support 1, with a scattering or emissive layer 3 coated above the array 2. An emulsion layer unit 4 is provided above the scattering layer 3. The top layer of the film is provided by a supercoat with antihalation means 5.

The emulsion layer unit 4 may comprise one or more layers. The unit is sensitive to light which has passed through each or all of the different color elements of the array 2. Thus the image information for each color record is recorded in the emulsion layer unit. The emulsions may be of different speeds. Photographic addenda known in the art, such as antifoggants and speed-increasing agents, may be present in or adjacent to the emulsion layers. Substances such as developing agents, blocked developing agents, color couplers and other materials which take part in the processing step may be in or adjacent to the emulsion layer unit 4. Developing agents suitable for including in the coating, and a preferred way of incorporating them, are disclosed by Simons in U.S. Pat. No. 5,804,359.

Figure 2:
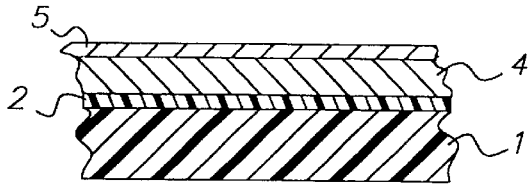
FIG. 2 is a diagram of a second embodiment of a film according to the invention.

FIG. 2 shows a second embodiment of the film in which the color filter array 2 is nearer to the support 1 than the emulsion layer unit 4. In this embodiment the scattering layer is omitted. Instead, scattering or emissive material is provided within the color filter array itself. A wide range of scattering or reflective materials may be used. For the required reflection or scattering to occur it is necessary that the reflection scanning illumination encounters phase boundaries between two or more media, at least one of the media being in a finely dispersed state, wherein refractive index differences of 0.2 or more occur across the phase boundaries. The continuous medium may be the binder for the layer, such as gelatin, or the solid or liquid substance which forms the individual filter elements. The dispersed medium may be of lower refractive index than the continuous medium, as in the case of fine air bubbles dispersed in the continuous medium, or the hollow core of small polymeric hollow spheres dispersed in the continuous medium. Alternatively, the dispersed medium may be of higher refractive index than the continuous medium, as in the case of particulate inorganic substances such as titanium dioxide. The mean particle or bubble size of the dispersed medium will affect the reflective performance, and should correspond to an effective particle diameter preferably between about 0.05 and 5 micrometers, and especially between 0.1 and 2 micrometers. Particles which are too small do not scatter light effectively, and particles which are too large will give a grainy appearance to images formed in the film of the invention.

A wide variety of inorganic particles compatible with silver halide photographic elements are available having a refractive index (n) of greater than 1.0 and, more typically, greater than 2.0. For example, Marriage, U.K. Patent 504, 283, Apr. 21, 1939, the disclosure of which is here incorporated by reference, discloses mixing with silver halide emulsions inorganic particles having refractive indices of "not less than about 1.75." Marriage discloses the oxide and basic salts of bismuth, such as the basic chloride or bromide or other insoluble bismuth compounds (refractive indices, n, about 1.9); the dioxides of titanium (n=2.7), zirconium (n=2.2), hafnium or tin (n=2.0), calcium titanate (n=2.4), zirconium silicate (n=1.95), and zinc oxide (n=2.2) as well as cadmium oxide, lead oxide and some white silicates. Yutzy and Carroll, U.K. Patent 760,775, here incorporated by reference, also discloses barium sulfate (baryta). It is also recognized that silver halide grains are capable of providing the refractive index (n) differences required for reflection.

An approach that is effective to improve the specularity of transmission during imagewise exposure through the interlayer unit relied upon for reflection during scanning is to form the discrete phase after imagewise exposure has occurred and before scanning. For example, the formation of titania particles in situ during photographic processing under alkaline conditions, which are required for development, in a photographic element containing titanyl oxalate is taught in Research Disclosure, Vol. 111, July 1973, Item 11128, the disclosure of which is here incorporated by reference. The metal salt of the organic acid as initially coated exhibits a refractive index approximating that of the photographic vehicle in which it is coated, whereas the subsequently formed titania has a refractive index (n) of >2.0. Additionally, Marriage U.K. Patent 504,283, incorporated by reference above, discloses similar procedures for forming the reflective particles within the emulsion layers. Although Marriage contemplates forming the particles before imagewise exposure, the same principles can be used to form the particles after imagewise exposure.

In constructing emissive units emissive components (e.g., dyes or pigments) may be dissolved or dispersed in the conventional photographic binder of the layer, or may be dissolved or dispersed in the solid or liquid substance which forms the individual filter elements.

The emissive components of the emissive interlayer units of the invention can be selected from among a wide variety of materials known to absorb light in a selected wavelength region and to emit light in a longer wavelength region. Table 1 provides examples of preferred emissive components. The spectral regions are indicated within which peak absorption (excitation) (Exc) and peak emission (Em) are located, where UV indicates the near ultraviolet (300 to 400 nm) spectral region and NIR indicates the near infrared (preferably 700 to 900 nm) spectral region. Where two spectral regions are indicated (e.g., UV/Blue) the half-peak bandwidth traverses the shared boundary of the spectral regions. Emissive components may be used in combination so as to emit light over a band of wavelengths sufficiently broad to be modulated by each of the three spectrally distinguishable types of color element.

TABLE 1

| | |
|---|---|
| EC-1 | p-Quaterphenyl<br>(Exc UV, Em UV) |
| EC-2 | 2-(1-Naphtyl)-5-phenyloxazole<br>(Exc UV, Em UV/Blue) |

TABLE 1-continued

| | |
|---|---|
| EC-3 | 2,2'-p-Phenylenebis(5-phenyloxazole) (Exc UV, Em Blue) |
| EC-4 | 2,2'-p-Phenylenebis(4-methyl-5-phenyloxazole) (Exc UV, Em Blue) |
| EC-5 | 7-Amino-4-methyl-2-quinolinol (Exc UV, Em Blue) |
| EC-6 | 7-Dimethylamino-4-methylcarbostyril (Exc UV, Em Blue) |
| EC-7 | p-Bis(o-methylstyryl)benzene (Exc UV, Em Blue) |
| EC-8 | 7-Diethylamino-4-methylcoumarin (Exc UV, Em Blue) |
| EC-9 | 4,6-Dimethyl-7-ethylaminocoumarin (Exc UV, Em Blue) |
| EC-10 | 4-Methylumbelliferone (Exc UV, Em Blue) |
| EC-11 | 7-Amino-4-methylcoumarin (Exc UV, Em Blue) |
| EC-12 | 7-Dimethylaminocyclopenta[c]coumarin (Exc UV, Em Blue) |
| EC-13 | 7-Amino-4-trifluoromethylcoumarin (Exc UV, Em Blue) |
| EC-14 | 4-Methyl-7-(sulfomethylamino)coumarin, sodium salt (Exc UV, Em Blue) |
| EC-15 | 7-Dimethylamino-4-methylcoumarin (Exc UV, Em Blue) |
| EC-16 | 4-Methylpiperidino[3,2-g]coumarin (Exc UV, Em Blue) |
| EC-17 | Tris(1-phenyl-1,3-butanedionol)terbium(III) (Exc UV, Em Green) |
| EC-18 | 2-(2-Hydroxyphenyl)benzoxazole (Exc UV, Em Green) |
| EC-19 | 2-(2-Tosylaminophenyl)-4H-3,1-benzoxazin-4-one (Exc UV, Em Green) |
| EC-20 | Europium (III) thenoyltrifluoroacetonate, 3-hydrate (Exc UV, Em Red) |
| EC-21 | 5-(4-Dimethylaminobenzylidene) barbituric acid (Exc UV, Em Red) |
| EC-22 | alpha.-Benzoyl-4-dimethylaminocinnamonitrile (Exc UV, Em Red) |
| EC-23 | Nonyl 4-[4-(2-benzoxazolyl)styryl]benzoate (Exc UV/Blue, Em Blue) |
| EC-24 | 7-Dimethylamino-4-trifluoromethylcoumarin (Exc UV/Blue, Em Green) |
| EC-25 | 4-Trifluoromethylpiperidino[3,2-g]coumarin (Exc UV/Blue, Em Green) |
| EC-26 | 2,2'-Dihydroxy-1,1'-naphthaldiazine (Exc UV/Blue, Em Green) |
| EC-27 | 1,2,4,5,3H,6H,10H-Tetrahydro-9-carbethoxy(1)benzopyrano(9,9a,1-gh)quinolizin-10-one (Exc Blue, Em Blue/Green) |
| EC-28 | 9-Acetyl-1,2,45,-3H,6H,10H-tetrahydrol[1]-benzopyrano(9,9a,1-gh)quinolizin-10-one (Exc Blue, Em Green) |
| EC-29 | 9-Cyano-1,2,4,5,-3H,6H,10H-tetrahydrol[1]-benzopyrano(9,9a,1-gh)quinolizin-10-one (Exc Blue, Em Green) |
| EC-30 | 9-(tert-Butoxycarbonyl)-1,2,4,5-3H,6H,10H-tetrahydro[1]benzopyrano(9,9a,1-gh)quinolizin-10-one (Exc Blue, Em Blue/Green) |
| EC-31 | 7-Amino-3-phenylcoumarin (Exc UV/Blue, Em Blue/Green) |
| EC-32 | 7-Diethylamino-4-trifluoromethylcoumarin (Exc UV/Blue, Em Blue/Green) |
| EC-33 | 2,3,5,6-1H,4H-Tetrahydro-8-methylquinolazino[9,9a,1-gh]coumarin (Exc UV/Blue, Em Blue/Green) |
| EC-34 | 3-(2'-Benzothiazolyl)-7-diethylamino-coumarin (Exc Blue, Em Green) |
| EC-35 | 3-(2'-Benzimidazolyl)-7-N,N-diethylamino-coumarin (Exc Blue, Em Green) |
| EC-36 | 3-(2'-N-Methylbenzimidazolyl)-7-N,N-diethylaminocoumarin (Exc Blue, Em Green) |
| EC-37 | 1,2,4,5,3H,6H,10H-Tetrahydro-8-trifluoromethyl(1)benzopyrano(9,9a,1-gh)quinolizin-10-one (Exc Blue, Em Green) |
| EC-38 | 7-Ethylamino-6-methyl-4-trifluoromethylcoumarin (Exc Blue, Em Green) |

TABLE 1-continued

| | |
|---|---|
| EC-39 | 9-Carboxy-1,2,4,5-3H,6H,10H-tetrahydro[1]-benzopyrano(9,91,1-gh)quinolizin-10-one (Exc Blue, Em Green) |
| EC-40 | N-Ethyl-4-trifluoromethylpiperidino[3,2-g]coumarin (Exc Blue, Em Green) |
| EC-41 | 8-Hydroxy-1,3,6-pyrene-trisulfonic acid, trisodium salt (Exc Blue, Em Green) |
| EC-42 | 3-Methoxybenzanthrone (Exc Blue, Em Green) |
| EC-43 | 4'-Methoxy-1,8-naphthyolene-1',2'-benzimidazole (Exc Blue, Em Green) |
| EC-44 | 4-(Dicyanomethylene)-2-methyl-6-(p-dimethylaminostyryl)-4H-pyran (Exc Blue, Em Red) |
| EC-45 | N-Salicylidene-4-dimethylaminoaniline (Exc Blue, Em Red) |
| EC-46 | 9-(o-Carboxyphenyl)-2,7-dichloro-6-hydroxy-3H-xanthen-3-one (Exc Blue/Green, Em Green) |
| EC-47 | Methyl o-(6-amino-3-imino-3H-xanthen-9-yl)benzoate monohydrochloride (Exc Green, Em Green) |
| EC-48 | o-(6-Amino-3-imino)-3H-xanthen-9-yl)benzoic acid hydrochloride (Exc Green, Em Green) |
| EC-49 | o-[6-(Methylamino)-3-(methylimino)-3H-xanthen-9-yl]benzoic acid (Exc Green, Em Green) |
| EC-50 | o-[6-(Ethylamino)-3-(ethylimino)-2,7-dimethyl-3 H-xanthen-9-yl]benzoic acid (Exc Green, Em Green) |
| EC-51 | Ethyl o-[6-(ethylamino)-3-(ethylimino)-2,7-dimethyl-3H-xanthen-9-yl]benzoate perchlorate (Exc Green, Em Green/Red) |
| EC-52 | Ethyl o-[6-(ethylamino)-3-(ethylimino)-2,7-dimethyl-3H-xanthen-9-yl]benzoate tetrafluoroborate (Exc Green, Em Green/Red) |
| EC-53 | [6-(Diethylamino)-3H-xanthen-3-yl]diethylammonium perchlorate (Exc Green, Em Red) |
| EC-55 | [9-(o-Carboxyphenyl)-6-(diethylamino)-3H-xanthen-3-ylidene]diethylammonium chloride (Exc Green, Em Red) |
| EC-56 | o-[6-(Dimethylamino)-3-(dimethylimino)-3H-xanthen-9-yl]benzoic acid perchlorate (Exc Green, Em Red) |
| EC-57 | 3-Ethyl-2-[5-(3-ethyl-2-benzoxazolinylidene-1,3-pentadienyl]benzoxazolium iodide (Exc Green, Em Red/NIR) |
| EC-58 | 5,9-Diaminobenzo(a)phenoxazonium perchlorate (Exc Green/Red, Em Red/NIR) |
| EC-59 | N-{6-(Diethylamino)-9-[2-(ethoxycarbonyl)phenyl-3H-xanthen-3-ylidene}-N-ethylethanaminium perchlorate (Exc Green, Em Red) |
| EC-60 | 3-(diethylamino)-6-(diethylimino)-9-(2,4-disulfophenyl)xanthylium hydroxide, inner salt (Exc Green, Em Red) |
| EC-61 | 8-(2,4-Disulfophenyl)-2,3,5,6,11,12,14,15-1H,4H,10H,13H-octahydrodiquinolizino[9,9a,1-bc;9,9a,1-hi]xanthanylium hydroxide inner salt (Exc Green, Em Red/NIR) |
| EC-62 | 3,7-Bis(ethylamino)-2,8-dimethylphenoxazin-5-ium perchlorate (Exc Green/Red, Em Red/NIR) |
| EC-63 | 3,7-Bis(diethylamino)phenoxazonium perchlorate (Exc Red, Em Red/NIR) |
| EC-64 | 9-Ethylamino-5-ethylimino-10-methyl-5H-benzo(a)phenoxazonium perchlorate (Exc Red, Em Red/NIR) |
| EC-65 | I-Phenyl-5-(4-methoxyphenyl)-3-(1,8-naphtholene-1',2'-benzimidazolyl-4)-2-pyrazoline (Exc Green, Em Red/NIR) |
| EC-66 | 5-Amino-9-diethylaminobenzyl[a]phenoxazolium perchlorate (Exc Red, Em Red) |
| EC-67 | Ethyl-1-[5-(3-ethyl-2-benzothiazolinylidene)-1,3-pentadienyl]benzothiazolium iodide (Exc Red, Em NIR) |
| EC-68 | 3-Ethyl-2-[7-(3-ethyl-2-benzoxazolinylidene)-1,3,5-heptatrienyl]benzoxazolium iodide (Exc Red, Em NIR) |

TABLE 1-continued

| | |
|---|---|
| EC-69 | 1,1'-Diethyl-4,4'-carbocyanine iodide (Exc Red/NIR, Em NIR) |
| EC-70 | 2-[5-(1,3-Dihydro-1,3,3-trimethyl-2H-indol-2-ylidene)-1,3-pentadienyl]-1,3,3-trimethyl-3H-indolium iodide (Exc Red, Em NIR) |
| EC-71 | 2-[7-(1,3-Dihydro-1,3,3-trimethyl-2H-indol-2-ylidene)-1,3,5-heptatrienyl]-1,3,3-trimethyl-3H-indolium perchlorate (Exc Red/NIR, Em NIR) |
| EC-72 | 2-[7-(1,3-Dihydro-1,3,3-trimethyl-2H-indol-2-ylidene)-1,3,5-heptatrienyl]-1,3,3-trimethyl-3H-indolium iodide (Exc Red/NIR, Em NIR) |
| EC-73 | 3-Ethyl-2-[7-(3-ethyl-2-benzothiazolinylidene)-1,3,5-heptatrienyl]benzothiazolium iodide (Exc Red/NIR, Em NIR) |
| EC-74 | 3-Ethyl-2-[7-(3-ethyl-2-benzothiazolinylidene)-1,3,5-heptatrienyl]benzothiazolium perchlorate (Exc Red/NIR, Em NIR) |
| EC-75 | IR-144 (Exc Red/NIR, Em NIR) |
| EC-76 | 1,1',3,3,3',3'-Hexamethyl-4,4',5,5'-dibenzo-2,2'-indotricarbocyanine perchlorate (Exc Red/NIR, Em NIR) |
| EC-77 | 5,5'-Dichloro-11-diphenylamino-3,3'-diethyl-10,12-ethylenethiatricarbo-cyanine perchlorate (Exc Red/NIR, Em NIR) |
| EC-78 | Anhydro-11-(4-ethoxycarboylpiperazin-1-yl)-10,12-ethylene-3,3,3',3'-tetramethyl-1,1'-bis(3-sulfopropyl)-4,5,4',5'-dibenzoindotricarbocyanine hydroxide triethylamine salt (Exc Red/NIR, Em NIR) |
| EC-79 | 3,3'-Di(3-acetoxypropyl)-11-diphenyl-amino-10,12-ethylene-5,6,5',6'-dibenzothiatricarbocyanine perchlorate (Exc Red/NIR, Em NIR) |
| EC-80 | Anhydro-1,1-dimethyl-2-{7-[1,1-dimethyl-3-(4-sulfobutyl)-2-(1H)-benz(e)indolinylidenel-1,3,5-heptatrienyl}-3-(4-sulfobutyl)-1H-benz(e)indolium hydroxide sodium salt (Exc Red/NIR, Em NIR) |

Figure 3:
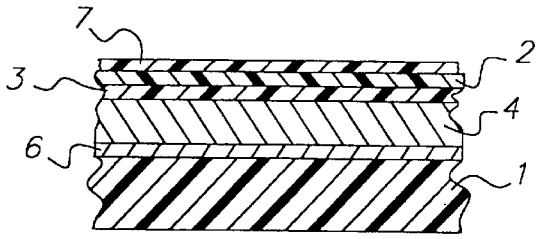
FIG. 3 is a diagram of a third embodiment of a film according to the invention.
Figure 4:
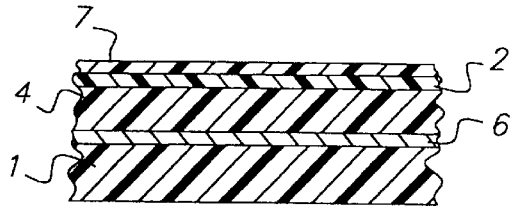
FIG. 4 is a diagram of a fourth embodiment of a film according to the invention.

FIGS. 3 and 4 show two embodiments of the film in which the film is coated with the emulsion layer unit 4 nearer to the support 1 than the color filter array 2. In the embodiment shown in FIG. 3 the film is provided with a scattering layer 3 between the color filter array 2 and the emulsion layer unit 4. An antihalation layer 6 is provided between the support 1 and the emulsion layer unit 4. The top layer of the film is provided by a supercoat 7. In FIG. 4 scattering or emissive material is provided within the color filter array layer 2.

Figure 5:
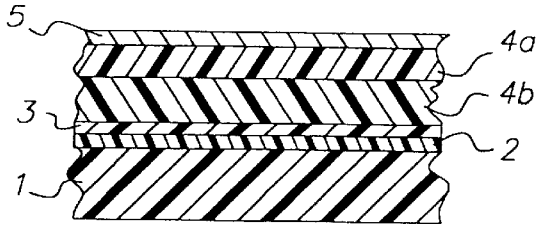
FIG. 5 is a diagram of a fifth embodiment of a film according to the invention.

FIG. 5 is similar to FIG. 1 but shows the emulsion layer unit 4 split into two emulsion layers 4*a* and 4*b*.

It is necessary for the emulsion layers to be exposed by light which has passed through the color filter array. After exposure, the emulsion layers may be developed and fixed by known methods of photographic processing so as to give an image which modulates light passing through each of the spectrally distinguishable types of filter element. Conventional black-and-white development, using developing agents contained in the solution and/or coated in the film, followed by fixing and washing, is a suitable form of photographic processing.

Conventional scanning techniques can be employed, including point-by-point, line-by-line and area scanning, and require no detailed description. A simple technique for scanning is to scan the photographically processed element point-by-point along a series of laterally offset parallel scan paths. The intensity of light received from or passing through the photographic element at a scanning point is noted by a sensor which converts radiation received into an electrical signal. The electrical signal is processed and sent to memory in a digital computer together with locant information required for pixel location within the image.

Figure 6:
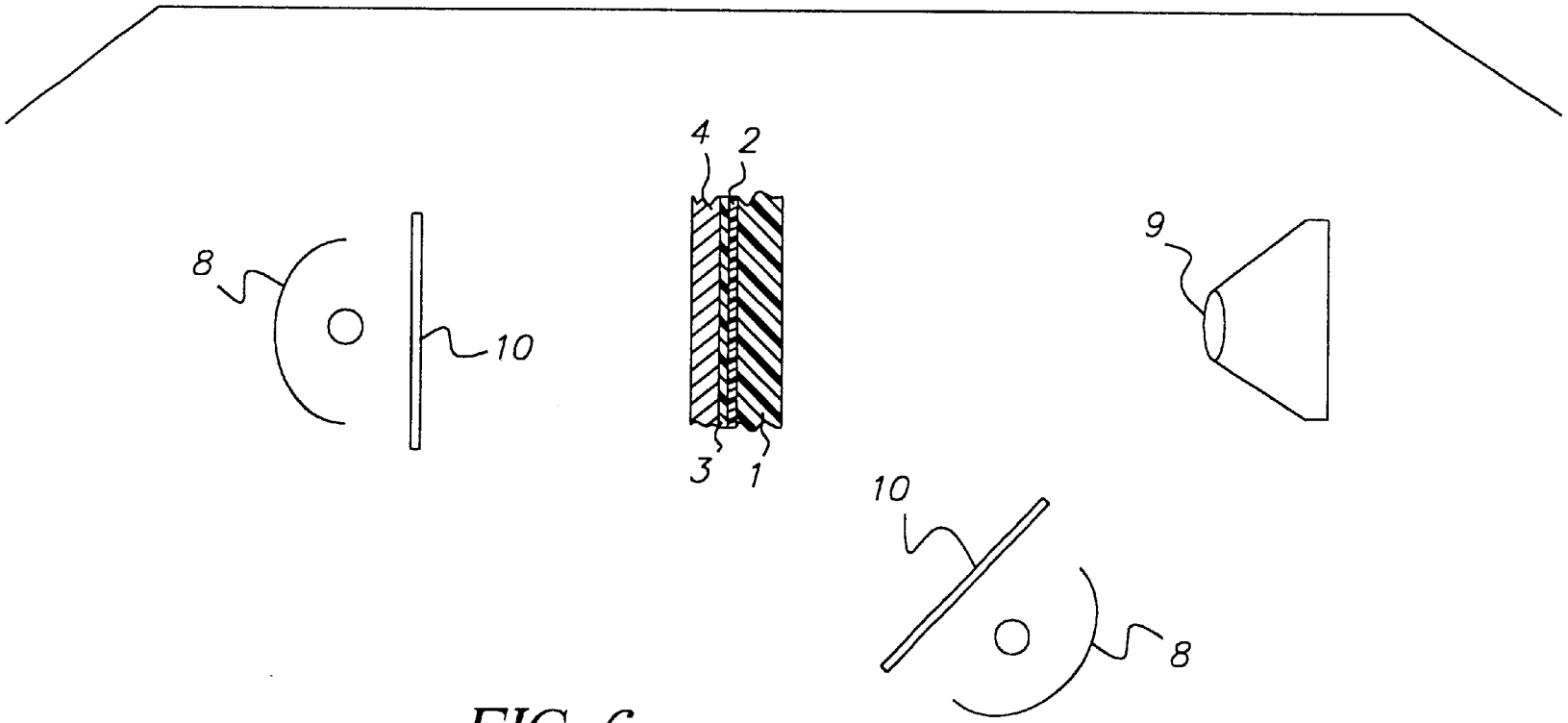
FIG. 6 shows an arrangement of a film and scanner suitable for carrying out the invention.

When scanning takes place it is necessary for the color filter array to be nearer to the scanner lens than the emulsion layers. A suitable arrangement is shown in FIG. 6.

A convenient form of scanner 9 can consist of a single multicolor image sensor or a single set of color sensors, with light sources 8 placed on both sides of the film. Light transmitted through the film can give information on the image pattern in the emulsion layer as modulated by the color filter array and light reflected or emitted from the film can give information essentially unmodulated by the image information in the emulsion layers. Color filters 10 may optionally be placed in front of the light source 8.

Whether a film with a regular CFA or irregular CFA is used the primary image processing of the film comprises two steps. In practice the two steps can be combined. Firstly, for each scanned color record, the modulation in the image data that relates to the scene content is separated from the modulation that relates to the structure of the color filter array. Secondly, where there is insufficient or missing scene information at any pixel position in any color record, this information is reconstructed by means of interpolation over neighboring pixels and/or color records.

A suitable method of image processing is given in U.S. patent application Ser. No. 09/080,791 now U.S. Pat. No. 6,188,804. This document describes a method of processing a randomly or irregularly sampled image or signal to reconstruct a regularly sampled output image or signal. This method, although described with respect to image data from which information is missing either randomly or irregularly (as is the case with scanned data from a film which incorporates a random color filter array) is also applicable to image data from which information is missing regularly, as in the case of a regular color filter array. This method is the preferred method of image processing to be used in conjunction with the film described above.

According to this preferred method the reconstructed image signal for each color channel, G(i, j, c), is given by:

$$G(i, j, c) = \frac{1}{N(i, j, c)} \sum_{b=-n/2}^{n/2} \sum_{a=-m/2}^{m/2} \frac{K(a, b, c)F(i-a, j-b, c)M(i-a, j-b, c)}{T(i-a, j-b, c)} \quad (1)$$

where

F(i, j, c) is the scanned signal corresponding to the image pattern in the emulsion layer(s) as modulated by the color filter array incorporated in the film, for each scanner pixel position, (i, j), in each color channel, c;

T(i, j, c) is the proportional transmittance of the cfa for each color channel, c, at each pixel position (i, j).

T(i, j, c) corresponds to the scanned signal, in reflection or emitted from the film, of the film color filter array essentially unmodified by the image information in the emulsion layer(s), for each channel c, calibrated and normalized such that the sum of T(i, j, c) for each pixel over all channels is equal to a constant, typically 1.0.

M(i, j, c) is a binary mask for each color channel c wherein $M(i, j, c)=1$ if $T(i, j, c)>T_0$ and $M(i,j, c)=0$ if $T(i,j, c)\leqq T_0$ and where $T_0$ is a predefined threshold with a value close to zero;

K(a, b, c) is an FIR (Finite Impulse Response) filter with impulse response of size (m+1, n+1) chosen for color channel c; and N(i, j, c) is an adaptive normalization factor which is given by:

$$N(i, j, c) = \sum_{b=-n/2}^{n/2} \sum_{a=-m/2}^{m/2} K(a, b, c) M(i-a, j-b, c). \quad (2)$$

Additionally, $$\frac{K(a, b, c) F(i-a, j-b, c) M(i-a, j-b, c)}{T(i-a, j-b, c)}$$

The FIR filters, K(a, b, c), chosen for the interpolation of each color channel can each have different characteristics, dependent on the statistics of F(i, j, c). In the description above, n and m are even, that is, the FIR filter has an odd number of coefficients in both dimensions, and a modification is required to the limits on the summations in the case where n and/or m are odd.

Generally it is advantageous to employ a set of FIR filters of sizes (m+1, n+1) where m and n are variable, for each color channel for the purposes of interpolation. At each pixel, or output sampling position, a single FIR filter, is selected from the set of filters such that it is the filter of smallest spatial size that satisfies the criterion that $$\sum_{b=-n/2}^{n/2} \sum_{a=-m/2}^{m/2} K(a, b, c) M(i-a, j-b, c) T(i-a, j-b, c)$$

is greater than a pre-specified threshold value $V_0$ ($0<V_0 \leqq 1.0$, for the case where the K(a, b, c) is normalized to 1.0). If the filter set contains an FIR filter which has a single central coefficient of value 1.0, all other values being 0.0, (an all-pass filter), then where $T(i, j, c) \geqq V_0$ the all-pass filter will be selected according to the above criteria, and the output pixel value reconstructed without the use of interpolation. Hence, the advantage of employing a set of filters is to enable the interpolation to be tuned to the local characteristics of the sampling, thereby maximizing sharpness in areas where the information density is high whilst minimizing interpolation artifacts in areas of low information density.

In the example above, the function of the binary mask is to prevent quantization artifacts that result when $T(i, j, c) \rightarrow 0.0$. An alternative, preferred, approach to minimize the significance problems that could result in quantization is to generate the reconstructed output image signal using $$G(i, j, c) = \frac{\sum_{b=-n/2}^{n/2} \sum_{a=-m/2}^{m/2} F(i-a, j-b, c) K(a, b, c)}{\sum_{b=-n/2}^{n/2} \sum_{a=-m/2}^{m/2} T(i-a, j-b, c) K(a, b, c)} \quad (3)$$

As before, the FIR filter K(a, b, c) for each pixel position in each channel is generally chosen from a set of FIR filters of varying spatial size (including an all-pass filter) according to the criteria described above. Although the method described in the equation above applies to the independent two-dimensional reconstruction of each channel, c, of G(i, j, c), it will be understood that this method can be extended to take advantage of likely cross-correlation of the channels of the signal or image before the random sampling, by means of a three-dimensional interpolation employing one or more three-dimensional FIR filters.

EXAMPLE

A coating support with a color filter array upon it was prepared by taking a length of Polachrome (TM) 35 mm film and washing all the emulsion layers off by gently rubbing the film under a stream of hot water. This revealed the color filter array which comprised adjacent red, green and blue stripes each approximately 8 micrometers wide running the length of the film. The Status A densities of the separate stripes measured with a microdensitometer were approximately as follows:

Red stripe: 0.1, 1.2, 1.3 (through red, green and blue filters respectively)

Green stripe: 1.3, 0.1, 1.3 (through red, green and blue filters respectively)

Blue stripe: 0.1, 0.7, 0.8 (through red, green and blue filters respectively)

The strip of film bearing the array was then taped to wider film base for coating on a slide-hopper experimental coating machine. It was coated from aqueous melts to give layers as depicted in FIG. 5, and coated laydowns in grams per square meter ($g/m^2$) as stated:

Scattering Layer:

The scattering layer comprised small hollow polymeric spheres of about 0.5 micrometer diameter (Ropaque (TM) OP-96 dispersion supplied by Rohm and Haas) coated at 0.33 $g/m^2$ of solids, together with gelatin at 0.5 $g/m^2$.

Emulsion Layer 1:

Fast silver bromoiodide panchromatically sensitized emulsion (tabular grain, average diameter approx. 1.7 $\mu$m, thickness 0.13 $\mu$m, 4.5 mol % iodide), coated at 0.7 $g/m^2$, together with gelatin, 1.0 $g/m^2$. 4-hydroxy-6-methyl-1,3,3A, 7-tetraazindene, sodium salt, was also present at 1.5 g per mole of silver.

Emulsion Layer 2:

Mid speed silver bromoiodide panchromatically sensitized emulsion (tabular grain, average diameter approx. 1.1 $\mu$m, thickness 0.12 $\mu$m, 4.5 mol % iodide), coated at 1.0 $g/m^2$, slow silver bromoiodide panchromatically sensitized emulsion (tabular grain, average diameter approx. 0.7 $\mu$m, thickness 0.11 $\mu$m, 3 mol % iodide), coated at 0.7 $g/m^2$ together with gelatin, 1.0 $g/m^2$. 4-hydroxy-6-methyl-1,3,3A, 7-tetraazindene, sodium salt, was also present at 1.5 g per mole of silver.

Supercoat:

Gelatin, 1.6 $g/m^2$, hardener bis(vinylsulphonyl)methane, 0.072 $g/m^2$, and an antihalation dye whose color was dischargeable in the developer solution, coated as a particulate dispersion, 0.1 $g/m^2$.

Surfactants used to aid the coating operation are not listed in this example.

A length of the coated film was loaded into a camera in a 35 mm cassette, oriented with the clear film support nearest to the lens, and the coated layers furthest from the lens. A photograph was taken of an outdoor scene, with a shutter speed of 1/120 s and an aperture of f5.6.

The exposed film was developed for 2 minutes at 25° C. in the following developer solution:

| | |
|---|---|
| sodium carbonate (anh.) | 9 g/l |
| ascorbic acid | 7.5 |
| sodium sulphite (anh.) | 2.5 |
| sodium bromide | 0.5 |
| 4-hydroxymethyl-4-methyl- | |

-continued

| | |
|---|---|
| -1-phenyl-3-pyrazolidone | 0.35 |
| pH adjusted to 10.0 with dilute sodium hydroxide solution. | |

It was treated for 15 s with a stop bath (1% acetic acid aqueous solution) and fixed for 1 minute in Kodak "3000" Fixer Solution diluted 1+3 with water, then washed for 3 minutes and dried. A colored negative image of the scene was visible.

The negative image was scanned by means of a Kodak DCS 420 monochrome digital still camera fitted with a Micro Nikkor 105 mm lens. Color information was obtained by placing red, green or blue filters over the illuminating light source, which was a xenon flash gun. An infra-red excluding filter was placed over the camera lens. The negative image was positioned with its support side facing the camera lens. Red, green and blue scans were obtained in transmission and reflection mode, designated respectively as RedT, GreenT, BlueT, RedR, GreenR, and BlueR, by using light sources placed either coaxially with the lens and negative on the side of the negative furthest from the lens (transmission), or at an angle of about 45 degrees to the lens axis and on the same side of the negative as the lens (reflection).

Image processing was carried out according to the following scheme.

First, a piece of unexposed and fixed film (that is, with CFA but no image record) was scanned in reflection and transmission to obtain a set of calibration factors to relate the scanned data corresponding to the CFA in reflection and transmission. These factors were used to calibrate the RedR, GreenR and BlueR scanned data, thus providing, from its RedR, GreenR and BlueR scanned data, an estimate of the transmittances at each pixel position of the red, green and blue filters incorporated in the film with the negative image. The estimated red, green and blue transmittances of the CFA were normalized at each pixel position such that they summed to 1.0, thus providing the data for T(i, j, c) in equation (3) above.

The RedT, GreenT and BlueT data measured from the piece of film with the developed image corresponded directly to the transmittance of the emulsion layer as modulated by the color filter array incorporated in the film, and hence were substituted into equation (3) for F(i, j, c).

The FIR filters K(a, b, c) chosen to interpolate over neighboring pixel values to provide estimates for G(i, j, c) in equation (3), and the threshold used to switch between them, $V_0$, vary greatly dependent on the geometry and statistical characteristics of the CFA. For the CFA geometry of the film of this example, a set of Gaussian-shaped low-pass FIR filters, separated by octaves and including an all-pass filter, was used in all color channels for K(a, b, c). The threshold, $V_0$, was set at 0.3. Hence, according to the method described earlier, at pixel positions where T(i, j, c), for any channel, was greater than 0.3, the all-pass filter (K(a, b, c)=[1.0]) was used and the reconstruction equation reduced to G(i, j, c)=F(i, j, c)/T(i, j, c).

At all other pixel positions, where there was considered to be insufficient information at that pixel alone to provide a good reconstruction, one of the low pass filters was used for interpolation to provide an improved estimate. The resulting reconstructed image signal G(i, j, c) was, after conversion to printer code values by means of appropriate color management profiles, printed using a Kodak XLS8600 thermal printer to produce a colored representation of the scene.

The present invention provides an analytical image processing pathway which allows accurate reconstruction of the colors of the original scene and, because the properties of the color filter array are measured pixel by pixel, it does not need to make any presumptions about the color filter array. Thus the invention can employ random arrays, which are less costly to manufacture, and can also provide an accurate reconstruction from regular arrays which may have irregularities arising from the manufacturing process or from damage to or distortion of the array.

The invention is equally applicable whether the silver or monochrome image is developed in negative or positive mode.

It will be understood by those skilled in the art that further image processing may be employed to further improve the color or tonescale, the image structure or sharpness of the image. Any suitable technique can be used.

They invention has been described in detail with particular reference to certain preferred embodiments thereof, but it will be understood that variations and modifications can be effected within the spirit and scope of the invention.

| PARTS LIST | |
|---|---|
| 1. | support |
| 2. | color filter array |
| 3. | scattering or emissive layer |
| 4. | emulsion layer unit |
| 5. | antihalation means |
| 6. | antihalation layer |
| 7. | supercoat |
| 8. | light source |
| 9. | scanner |
| 10. | color filter |

What is claimed is:

1. A color film for recording an image comprising a support layer, a layer formed of a color filter array having at least three spectrally distinguishable types of color element and at least one emulsion layer, the film further including means for emitting or reflecting light which has been modulated by the color filter array but has not substantially been modulated by the image pattern formed in the at least one emulsion layer.

2. A color film as claimed in claim 1 wherein the means for reflecting light comprises a reflective layer interposed between the color filter array and the emulsion layer.

3. A color film as claimed in claim 1 wherein the means for emitting light comprises a scattering layer interposed between the color filter array and the emulsion layer.

4. A color film as claimed in claim 1 wherein the means for emitting light comprises a fluorescent layer interposed between the color filter array and the emulsion layer.

5. A color film as claimed in claim 1 wherein the means for reflecting light comprises reflective material located within the color filter array layer.

6. A color film as claimed in claim 5 wherein the material is located in the space between the color elements of the array.

7. A color film as claimed in claim 5 wherein the material is located within the color elements themselves.

8. A color film as claimed in claim 1 wherein the means for emitting light comprises scattering material located within the color filter array layer.

9. A color film as claimed in claim 8 wherein the material is located in the space between the color elements of the array.

10. A color film as claimed in claim 8 wherein the material is located within the color elements themselves.

11. A color film as claimed in claim 1 wherein the means for emitting light comprises fluorescent material located within the color filter array layer.

12. A color film as claimed in claim 11 wherein the material is located in the space between the color elements of the array.

13. A color film as claimed in claim 11 wherein the material is located within the color elements themselves.

14. A color film as claimed in claim 1 wherein the color filter array has a regular repeating pattern.

15. A color film as claimed claim 1 wherein the color filter array has a random pattern.

* * * * *